US005833046A

United States Patent [19]

Smith et al.

[11] Patent Number: 5,833,046

[45] Date of Patent: Nov. 10, 1998

[54] PARTITION CONTROL ASSEMBLY

[75] Inventors: Dwight L. Smith, Kennesaw, Ga.; Steve Blomquist, Tuscan, Ariz.; David R. Bacco, Canton; Frank Moncrief, Acworth, both of Ga.

[73] Assignee: Riverwood International Corporation, Atlanta, Ga.

[21] Appl. No.: 710,903

[22] Filed: Sep. 24, 1996

[51] Int. Cl.[6] ..... B65G 47/26

[52] U.S. Cl. ..... 198/458; 53/157; 53/263

[58] Field of Search ..... 53/263, 157; 198/445, 198/458

[56] References Cited

U.S. PATENT DOCUMENTS

| | | | |
|---|---|---|---|
| 2,968,898 | 1/1961 | Hickin | 53/157 |
| 3,381,452 | 5/1968 | Gentry et al. | 53/157 |
| 3,719,018 | 3/1973 | Focke et al. | 53/157 |
| 3,760,557 | 9/1973 | McIntyre | 53/157 |
| 4,054,020 | 10/1977 | Devilbiss | 53/157 |
| 5,485,713 | 1/1996 | Moncrief | 53/157 |
| 5,600,936 | 2/1997 | Moncrief et al. | 53/157 |

*Primary Examiner*—Joseph E. Valenza

[57] ABSTRACT

A partition control assembly within a continuous-motion automatic packaging machine receives and controls the motion of partitions which are ejected at high speeds from a partition ejection mechanism for insertion between preconfigured groups of articles disposed on a flight conveyor in the machine. The partition control assembly includes a first member having a contoured guiding surface for receiving a leading edge of the partition and for guiding the partition into a lateral, downward direction in relation to the partition ejector. Disposed opposite the first member is a second member which includes a control surface disposed opposite the contoured guiding surface, creating an interior control space between the control and contoured guiding surfaces. The control surface receives the partition upon lateral translation thereof, terminates lateral translation of the partition, and includes an inverted ledge for engaging a top edge of the partition to prevent the partition from recoiling upwardly from within the plurality of preconfigured articles after the partition contacts the flight conveyor. A method for controlling the insertion of a partition into a preconfigured group of articles includes the step of aligning the articles with a partition ejector, ejecting the partition downward into the articles and restraining the partition from upward movement after the partition travels a predetermined distance.

38 Claims, 5 Drawing Sheets

PARTITION CONTROL ASSEMBLY

FIELD OF THE INVENTION

This invention relates to a method and apparatus for guiding a planar object, such as a partition, from a partition ejection point to a predetermined position amongst a group of articles arranged in a preconfigured fashion on a flight conveyor. The invention is particularly suited for use in packaging machines that insert planar partitions into preconfigured product groups. More specifically, this invention includes specific elements which guide a partition from a partition ejection mechanism, impart surface friction forces to the partition after ejection to effectuate motion control on the partition, and prevent the partition from becoming misaligned with respect to the preconfigured product group.

BACKGROUND OF THE INVENTION

Automated, continuous-motion systems for handling products select an article from an article supply magazine, and deliver the article to a predetermined location for packaging. Often, article delivery must be accomplished in synchronization with other functions of the automated machinery. For example, packaging machines may be used for selecting, grouping and packaging of products, such as beverage containers, into a carton or carrier. Such devices select the articles from an infeed area, group the articles into a predetermined configuration, and insert the preconfigured articles into a carton or carrier.

To assist in preventing breakage among groups of articles packaged with carriers, the carrier will frequently include a partition inserted between some of the articles. Some partitions are formed integrally with the carton, while others are embodied as separate inserts. Where the partition is embodied as a separate insert, the packaging process must include an additional step of inserting the partition within the group of preconfigured articles prior to insertion of the group within the carrier. While some packaging devices interrupt the flow of articles on a flight conveyor to perform various stages of work, most automated packaging machines, such as continuous-motion, high capacity devices, do not interrupt product flow, requiring all tasks to be performed while the products are moving through the machine, often at high rates of speed.

Given the high rate of product flow through the machine, partition ejection systems, such as the one disclosed in Applicant's U.S. patent application Ser. No. 08/418,101, filed on Apr. 6, 1996, now U.S. Pat. No. 5,564,894, select a partition from a stack and transport the partition to a firing mechanism, which rapidly moves the partition from the ejector to within a group of articles on a flight conveyor. The ejector firing mechanism may be comprised of a slow speed feeding mechanism which feeds the partition to several pairs of opposed gripping wheels rotating at a high angular velocity. When the partition reaches the gripping wheels, gripping surfaces on circumferences of the gripping wheels contact both planar surfaces of the partition simultaneously and impart a high velocity motion to the partition, ejecting the partition into the group of articles on the conveyor at a high rate of speed. Rapid firing of the partitions into the preconfigured product groups is very important in the context of continuous-motion packaging machinery, since the criticality of firing timing decreases with increasing firing speed.

Generally, packaging techniques utilize two types of partitions which are separately inserted into the preconfigured product group. A first type is known as the winged partition, because the generally planar partition has "wing" portions which project transversely from lateral ends of the partition. The wing portions may be disposed perpendicularly with respect to a main portion of the partition and may contact opposite side walls of a carrier or edges of the articles within the preconfigured group to stabilize and facilitate placement of the partition within the carrier or preconfigured product group. A second type of partition is generally known as the wingless partition, since it is merely a planar element, and contains no transversely extending portions or wings. Where several partitions are required between columns of a group of preconfigured articles, it is often desirable to alternate winged and wingless partitions between adjacent columns to preclude interference of wings between adjacent partitions. For example, a preconfigured product group having a total of four article columns may contain a winged partition between the first and second article columns, a wingless partition between second and third article columns, and a winged partition between third and forth article columns.

Upon firing of a winged partition into a preconfigured product group, frictional forces imparted to the surfaces of the wings by articles in the group or by interior surfaces of the carrier serve to control the velocity and placement of the partition within the group. For example, in a firing sequence for a winged partition, the ejector opens the wings, fires the partition into the preconfigured article group, and the wings tend to wrap around or close upon the articles within the group. The closing or wrapping action of the wings provides the above-referenced friction control of winged partition motion into the group of articles, insuring consistent, accurate placement of the partition within the article group.

Wingless partitions, on the other hand, do not derive sufficient friction control from front and back partition surface contact with the group of articles during a firing sequence to properly control the partition speed within the preconfigured article group, since only tangential contact exists between the article and partition surfaces, assuming the articles are cylindrical in shape. Often, the wingless partition will bounce or recoil of off a bottom portion of the product group, such as a flight conveyor surface. That recoiling effect results in the partition coming to rest in a position which is above its desired position. Often times the partition will become misaligned with respect to the preconfigured article group after recoil and will cause improper or damaged packaging at subsequent workstations within the packaging machine, causing excessive packaging machine shut downs, which result in reduced packaging productivity.

Many attempts to mitigate the partition recoiling effect have been made. Decreasing the ejection velocity of the winged partition to mitigate recoiling is not desirable since the time window associated with partition reception is rather thin due to the rapid, continuous movement of the flight conveyor through various packaging workstations. Therefore, attempts have been made to increase frictional forces imparted the wingless partition surfaces. For example, one attempt included brushes orientated in a downward direction which contacted opposing surfaces of the wingless partition as it travelled into the preconfigured group of products. However, the partition would recoil off of the conveyor and reenter the brush area between the ejector and the article group. Thus, the addition of brushes did not preclude the jamming and misalignment of wingless partitions.

SUMMARY OF THE INVENTION

Generally speaking, the invention relates to a device for controlling the motion of partitions which are inserted between preconfigured groups of articles processed in continuous-feed mechanisms for packaging articles. More specifically, the present invention relates a partition control assembly which receives and controls the motion of a wingless partition from a high-speed partition ejector. The assembly is adapted to control the downward movement of the wingless partition into a plurality of preconfigured articles on a flight conveyor.

The partition control assembly includes a first member disposed below a partition ejector. The first member includes a contoured guiding surface for receiving a leading edge of the partition and for guiding the partition into a lateral, downward direction with respect to the partition ejector after the partition exits the partition ejector. In a preferred embodiment, a longitudinal axis of the partition is substantially parallel to a direction of flight conveyor movement. In that embodiment, the contoured guiding surface translates the partition laterally with respect to a centerline of the flight conveyor.

Disposed opposite the first member is a second member which includes a control surface disposed opposite the contoured guiding surface, creating an interior control space between the control and contoured guiding surfaces. The contoured guiding surface tapers toward the control surface in a downward direction, thereby imparting a lateral motion to the partition. The control surface receives the partition upon lateral translation thereof, and terminates lateral translation of the partition.

The control surface also functions to prevent upward movement of the partition after the partition enters the control space and makes an initial contact with the flight conveyor. More specifically, the control surface includes inverted ledge for engaging a top edge of the partition to prevent the partition from recoiling upwardly from within the plurality of preconfigured articles after an initial contact between the partition and the flight conveyor. In a preferred embodiment of the partition control assembly, a bottom portion of the contoured guiding surface extends directly below the inverted ledge within the control space, thereby insuring lateral movement of the partition is sufficient to implement engagement of the partition upper edge with the inverted ledge upon the recoil motion.

The partition control assembly includes sufficient clearance room below the first and second members to allow upstanding cleats on the flight conveyor to pass thereunder. The upstanding cleats are spaced apart from one another on the flight conveyor by a predetermined distance and generally provide support to advance the preconfigured groups of articles along the conveyor, through each workstation in the continuous-motion packaging machine. In a preferred embodiment, since the vertical motion arrested partition must move along the flight conveyor with the preconfigured group, the partition control assembly includes an opening between the first and second elements at their downstream edges so that the upstanding cleat on the flight conveyor may move the partition out of the control space and along with the preconfigured group for further downstream processing.

A preferred embodiment of the invention may also include the partition control assembly in an article group splitter above the flight conveyor, which allows the articles to be split into two portions, with the wingless partition inserted between the two portions.

The partition control assembly may also include several features which allow personnel to view and access the control space in the event that partition jam occurs with the control assembly. For example, a portion of the second member, below the inverted ledge, may be constructed from a transparent material, such as a polycarbonate sheet, for allowing visual monitoring of the control space for partition jams. In a preferred embodiment, the partition control assembly may also include a hinge for mounting the first and/or second members to the assembly, wherein the hinge allows the first and/or second members to be rotated away from the assembly to provide for access to the control space for removing jammed partitions.

The partition control assembly may also include sensing means for detecting the presence of a partition jam with the control space. For example, the assembly may include a sensor which is responsive to a partition jam in the control space for deactivating the flight conveyor. Additionally, the sensor may also be responsive to the presence of a partition jam for deactivating the partition ejector, thereby preventing further insertions of partitions into the control space. Deactivating the flight conveyor or partition ejector allows a machine operator, technician, or engineer to examine the workstation area and clear debris from the control space. The sensing means may comprise any device which may detect the presence or absence of a partition in the control space, such as an optical sensor having a light beam focused on the control space, wherein the sensor detects a light reflection when a partition is in the control space. The sensing means may sample the control space immediately prior to ejection of a partition into the group of articles, and shut down the conveyor and/or ejector if a partition from a previous ejection cycle still remains in the control space. Alternatively, the sensing means may sample the control space in synchronization with predetermined flight conveyor positions, and shut down the conveyor and/or partition ejector if a partition is not detected at a predetermined flight conveyor position. As another alternative, if the sensing means does not detect a partition when the partition should be in control space immediately after an ejection sequence, then the control system may shut down the conveyor and/or the partition ejector.

The partition control assembly may also include means for allowing downstream movement of the partition control assembly in a direction of flight conveyor movement upon encountering excessive resistance from articles on the flight conveyor. Furthermore, the partition control assembly may include sensing means responsive to downstream movement of the partition control assembly for deactivating the flight conveyor.

The present invention may also relate to an entire packaging machine for processing articles along a longitudinal path and for directing articles into a container comprising article infeed means for arranging the articles into preconfigured groups, a flight conveyor for moving the articles along a longitudinal path, a partition ejector disposed above the flight conveyor for ejecting a partition in a downward direction into a preconfigured groups article below the partition ejector on the flight conveyor, and a partition control assembly disposed between the partition ejection mechanism and the flight conveyor, wherein the partition control assembly prevents the partition from recoiling out of the preconfigured group of articles after an initial contact with the flight conveyor.

A packaging machine in accordance with the present invention may include all of the elements discussed above in the partition control assembly, including the first and second members, the control and contoured guide surfaces, and the inverted ledge for restricting upward movement of the ejected partition after an initial contact with the flight conveyor. The packaging machine may also include the sensors as discussed above for detecting a partition jam within the partition control assembly, and for detecting an article jam on the flight conveyor.

Finally, the present invention also relates to a method for controlling the ejection of a partition into a group of preconfigured articles on a flight conveyor, comprising the steps of aligning a group of preconfigured articles on the flight conveyor with a partition ejector positioned above the flight conveyor, ejecting a partition downward into the group of preconfigured articles, deflecting the partition laterally with respect to a longitudinal axis of flight conveyor movement, and restraining the partition from upward movement after the partition travels a predetermined downward and lateral distance.

The method may also include the additional steps of sensing for the presence of a partition jam below a partition ejector at a predetermined time interval for deactivating the flight conveyor and/or partition ejector in response to a partition jam within the partition control assembly. Alternatively, the method may include the step of sensing for the presence of a partition below a partition ejector in synchronization with predetermined flight conveyor positions, and deactivating the flight conveyor and/or ejector in response to the sensing of a partition jam below the partition ejector at one of the predetermined flight conveyor positions. The sensor may also sample the partition control assembly between partition ejection cycles to detect for a partition jam. Finally, the method may also include the step of sensing for downstream movement of the partition control assembly to detect jammed or misaligned articles on the flight conveyor.

It is therefore an object of the present invention to provide an apparatus for preventing the recoiling action associated with ejecting a partition into a preconfigured group of articles, and to implement a means for generally imparting surface friction to an ejected partition for the purpose of controlling partition motion.

DETAILED DESCRIPTION OF THE PREFERRED EMBODIMENTS

Figure 1:
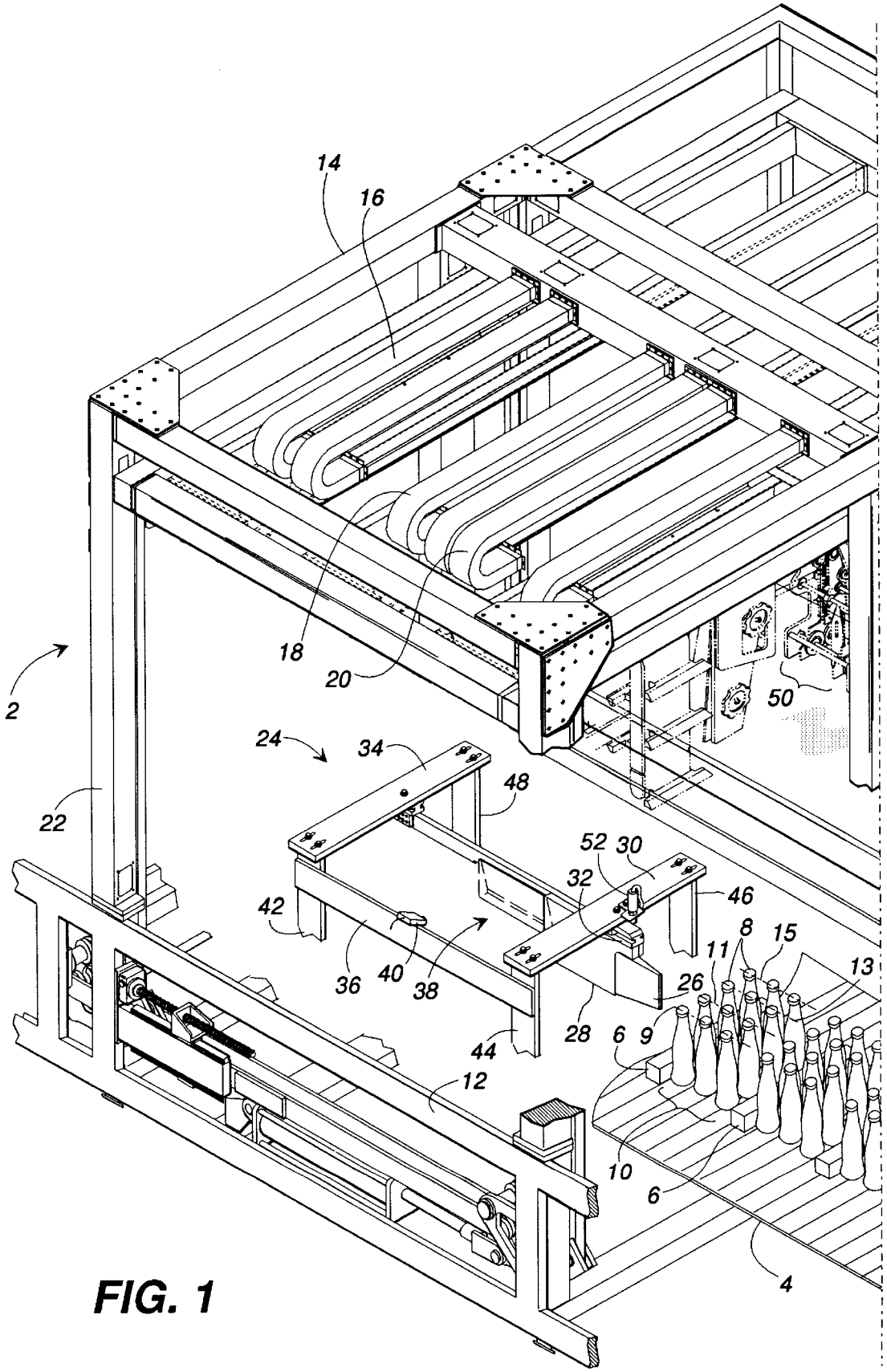
FIG. 1 is a perspective, elevational view of a flight conveyor of a packaging machine and a partition control assembly in accordance with the present invention.

FIG. 1 illustrates a perspective view of a continuous motion automatic packaging machine 2. Packaging machine 2 includes a flight conveyor 4 having upstanding cleats 6 which separate articles 8 into preconfigured groups 10 for packing into cartons or carriers. Articles 8 may include nearly any object which may be packed into a carton or carrier, including but not limited to metal cans or glass bottles. Often, especially in the case of packaging glass bottles, proper packaging requires the use of inserts placed between columns 9, 11, 13, and 15 of the preconfigured group 10 for the purpose of mitigating damage caused by inter-article contact during packaging and shipping. Thus, one particular workstation within packaging machine 2 inserts partitions into the preconfigured group of articles 10, as is explained in greater detail below.

Packaging machine 2 includes a lower chassis 12 which supports mechanisms for performing tasks at various workstations on the preconfigured group of articles 10 as they progress through the packaging machine 2 on conveyor 4. Typically, lower chassis 12 will support rollers and drive mechanisms for the flight conveyor 4, as well as infeed mechanisms which sort and place articles 8 onto flight conveyor 4.

One workstation which exists within the packaging machine 2 is the partition ejector station. FIG. 1 generally shows the ejector station portion of the packaging machine 2. An upper chassis 14 movably supports various partition ejectors which "fire" partitions into the preconfigured group of articles 10 as they progress through the partition ejection workstation on flight conveyor 4. More specifically, upper chassis 14 may include pairs of rails 16, 18 and 20, each of which serve to slidably support a separate partition ejector. Generally, the partition ejection workstation may eject two types of partitions into the preconfigured article group 10. The first partition is "winged" in that it is generally planar, but includes several "wings" on its ends which project transversely from the planar portion. While the planar portion may fit between the columns of a preconfigured group, the wings generally tend to wrap around articles disposed opposite one another at each end of a column. The second type of partition is the wingless partition, which consists of simply a planar material placed between columns of articles. The partitions may be comprised of any material, but the preferred material is cardboard or some other inexpensive, durable paper product.

In the partition ejection workstation illustrated in FIG. 1, a first partition ejector (not shown) on rails 20 may eject a winged partition between columns 9 and 11 or between columns 13 and 15 of preconfigured article group 10. The wings of the winged partition will tend to wrap around the first and last pairs of articles in the column. Similarly, partition ejector 50, ejects a wingless partition between columns 11 and 13 of the preconfigured article group 10 as the group moves through machine 2. Finally, a third partition ejector (not shown) disposed downstream of ejector 50 may eject another winged partition between columns 9 and 11 or columns 13 and 15 of the preconfigured article group 10. Partition ejector 50 must eject a wingless partition between columns 11 and 13 to prevent interference with wings from partitions sitting between columns 9 and 11, and columns 13 and 15. Each partition ejector is adapted to be moved away from the flight conveyor 4, so that in the event of a partition jam, the ejectors may be moved on their rails laterally away from the conveyor to allow personnel to clear jammed articles or partitions.

Lower chassis 12 also supports a splitter assembly 24. Splitter assembly 24 generally includes a splitter member 28 disposed parallel to a longitudinal axis of the direction of motion of conveyor 4. Splitter 28 includes a leading edge wedge 26 which forces the preconfigured product group 10 into two separate groups in preparation for the insertion of a wingless partition therebetween. Splitter member 28 is generally supported by upstream transverse member 30 and downstream transverse member 34. Upstream and downstream transverse members 30 and 34 are supported by vertical splitter support members 42, 44, 46 and 48 at end portions thereof. Lower portions (not shown) of the vertical splitter support members 42, 44, 46 and 48 are generally fastened by conventional means to a lower portion of lower chassis 12, so as to position splitter member 28 at approximately a centerline of the flight conveyor 4.

When wedge 26 encounters excessive resistance from misaligned articles moving downstream on flight conveyor 4, splitter member 28 may move downstream. Specifically, an upper portion of splitter member 28 includes elongated slots 32 which matingly receive complimentary elongated protrusions (not shown) on bottom portions of upstream and downstream traverse members 30 and 34 to allow longitudinal movement of splitter member 28. Frictional engagement between the elongated protrusions and slots provides an adequate counter-force to resist normal axial forces associated with splitting the preconfigured article group 10. However, when an excessive splitting force from misaligned articles impinges on splitter member 28, an axial component thereof overcomes frictional forces within elongated slots 32 and translates splitter member 28 downstream.

A motion sensor 52 detects longitudinal downstream motion of splitter member 28 and sends a signal to the packaging machine control system. When the control system receives such a signal, it may temporarily halt the motion of flight conveyor 4 and/or shut down the partition ejectors to allow qualified personnel to clear an article jam in a vicinity of splitter member 28. Sensor 52 may comprise any type of sensor which detects longitudinal motion. Examples include, but are not limited to optical sensors, linear motion transducers, or piezoelectric sensors.

Splitter member 28 also includes a partition control assembly 38, which has an elongated, funnel-shaped interior for controlling the motion of a wingless partition ejected from partition ejector 50 into the preconfigured group of articles 10 after it has been split by splitter member 28. Finally, a rear sensor mounting member 36 carries a partition sensor 40 for detecting the presence of a partition within partition control assembly 38, for the purpose of detecting partition jams therein, as is explained in greater detail below.

Figure 2:
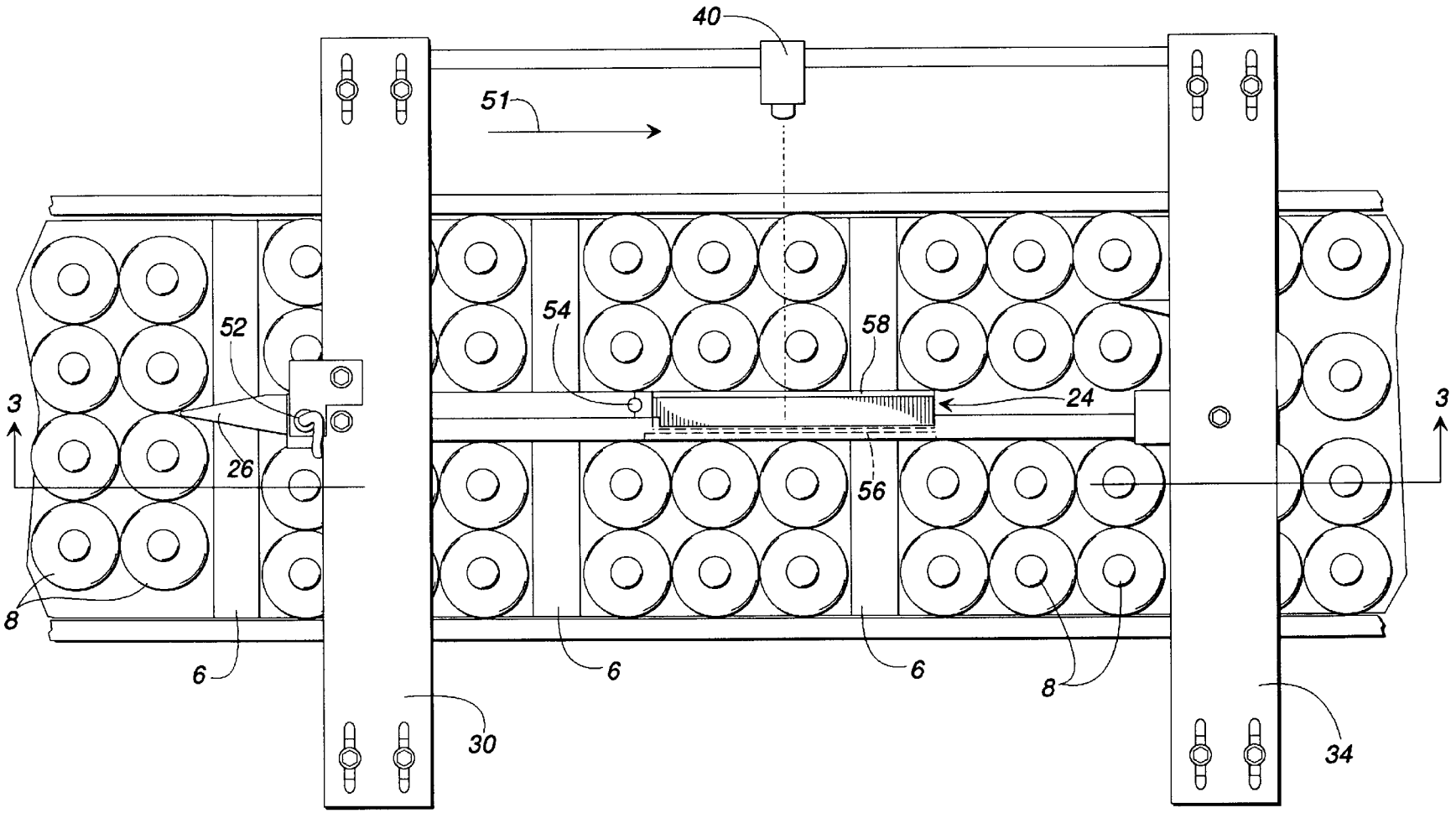
FIG. 2 is a top elevational view of the partition control assembly in accordance with the present invention.

FIG. 2 illustrates a top plan view of the partition control assembly within splitter member 28 as preconfigured groups of articles 10 progress downstream along conveyor 4 in a direction indicated by arrow 51. As explained above, product columns 11 and 13 are split apart by wedge 26 and divided into two groups passing on either side of splitter assembly 24.

During a firing sequence at the partition ejection workstation, partition 66 exits the partition ejector at an extremely high velocity. A high partition ejection speed is required in a continuous-motion automatic packaging machine, since the flight conveyor 4 does not halt at the partition ejection workstation. Thus, partition ejection timing is very critical in terms of longitudinal alignment of the partition with respect to the preconfigured group of articles 10 on flight conveyor 4. As partition ejection speed increases, timing of partition ejection with respect to the position of preconfigured group 10 becomes much less critical, enlarging the time slot for ejection and lessening the likelihood of longitudinal partition misalignment with respect to the group 10.

A rapid firing speed for the winged partitions does not present a problem, since additional surface friction associated with contact between the wings and article surfaces tends to impart a control force over the winged partition, arresting partition motion upon contact with the flight conveyor 4. When firing wingless partitions in the absence of a partition control assembly, however, partition motion control becomes a problem because of reduced surface area contact and thus reduced frictional forces between the partition and article surfaces. As was explained above, the partition tends to impact a top surface of the flight conveyor and recoil upwardly therefrom. However, the partition control assembly imparts additional surface friction onto the partition, translates the partition laterally with respect to a longitudinal axis of the assembly, and limits the upward recoiling motion associated with the partition's contact with the flight conveyor.

Figure 4A:
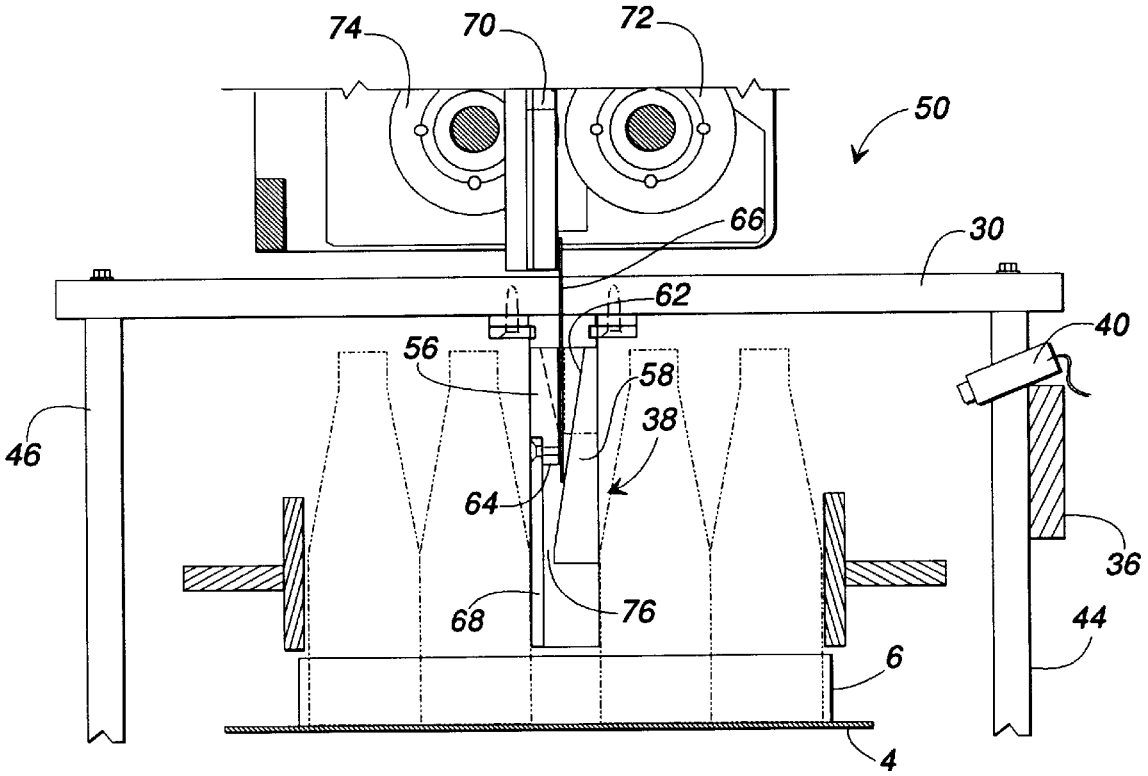
FIGS. 4A–4D sequentially illustrate schematic left side views of progressive movements of an ejected partition within the partition control assembly during an ejection phase.

FIG. 4A illustrates a left side view and downstream end of the partition control assembly. The partition control assembly is generally comprised of a control member 58 which includes a slanted guiding surface 62. A control member 56, which is disposed opposite guide member 58, includes a top tapered surface 60, an inverted ledge 64 and a transparent, substantially planar viewing member 68. Tapered surface 60 and guiding surface 62 form an elongated funnel which receives partition 66 from partition guide 70 after partition 66 has been launched by the rapidly spinning firing wheels 72 and 74.

Figure 4B:
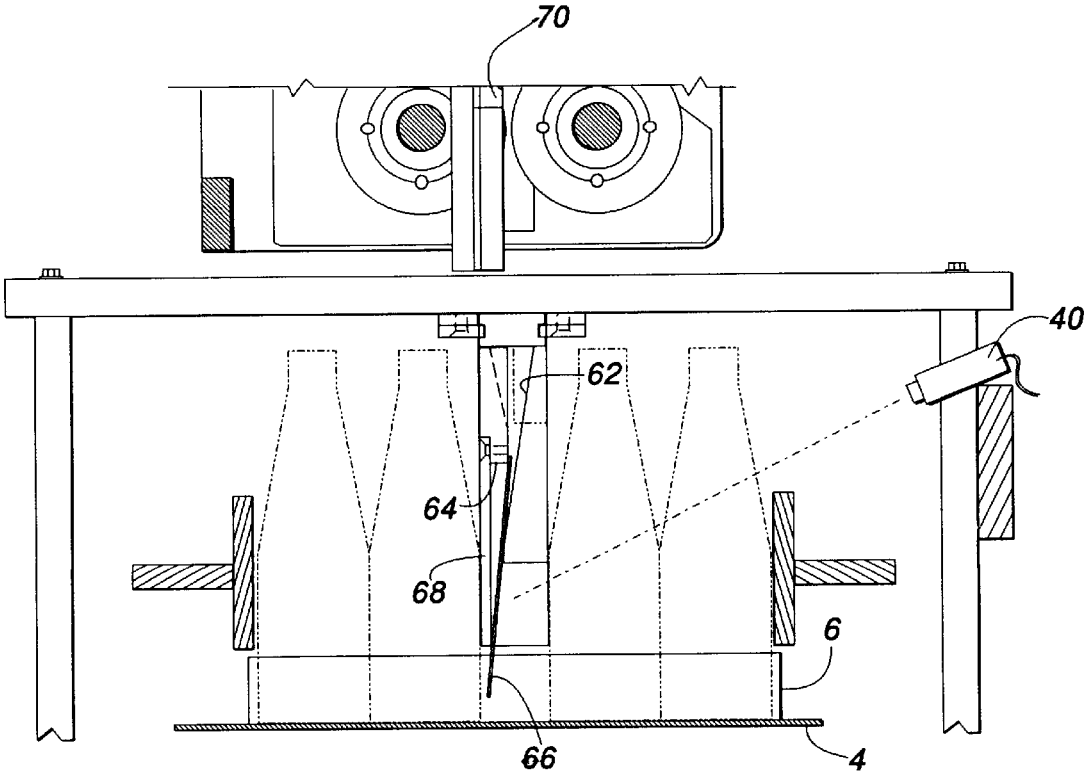

During a firing sequence, the partition ejector fires a partition 66 down into the partition control assembly 38. The partition 66 immediately contacts guiding surface 62 which directs the partition laterally, as is illustrated in FIG. 4B. Transparent viewing member 68 restricts lateral movement of the partition 66 to a predetermined distance essentially determined by the width of inverted ledge 64.

Figure 4C:
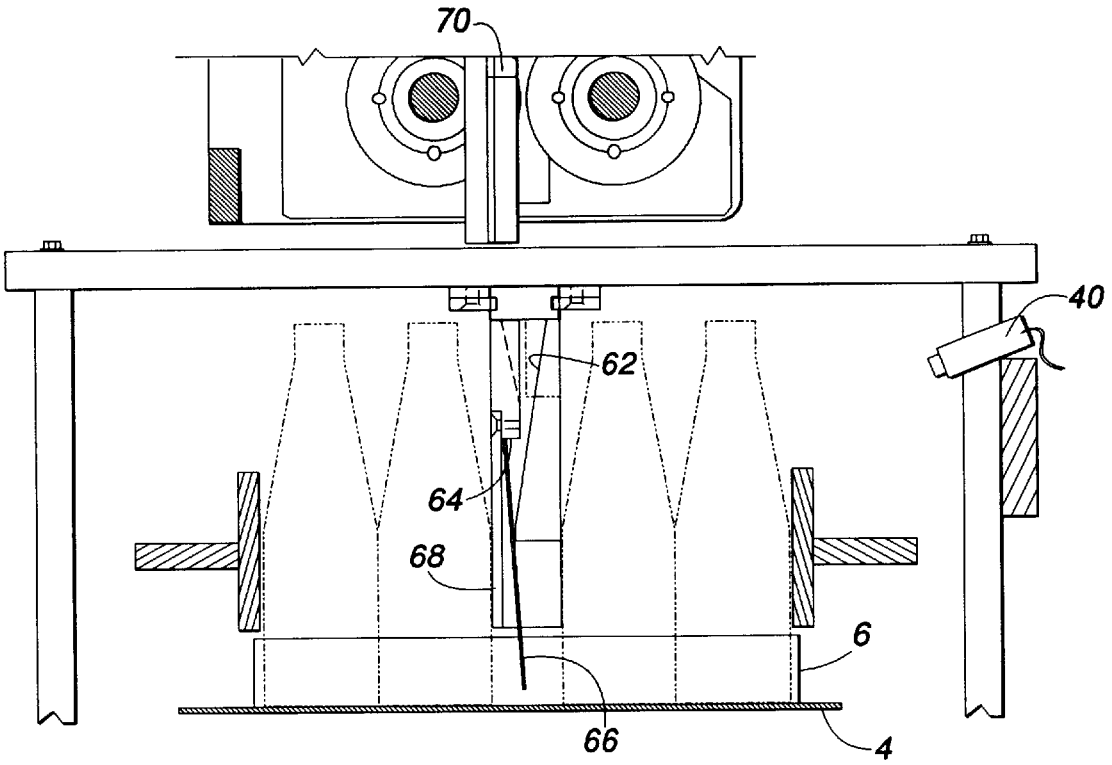
Figure 4D:
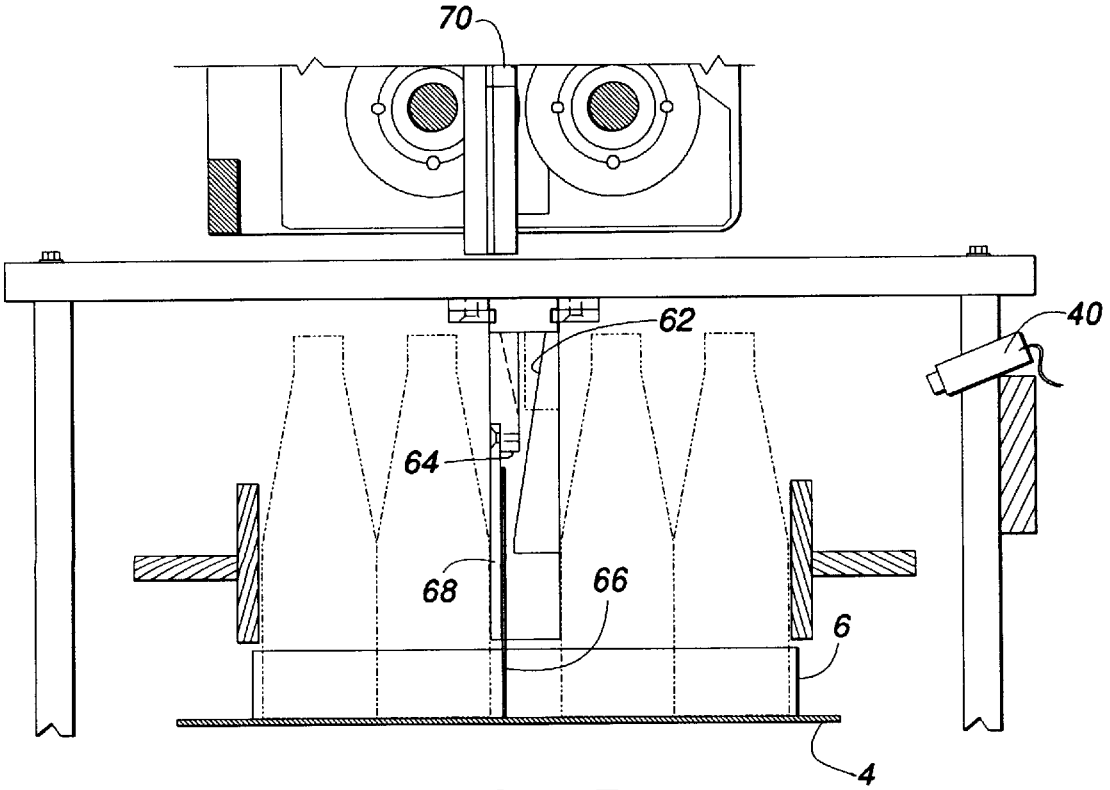

Referring to FIG. 4C, after the partition 66 contacts a top surface of conveyor 4, the partition 66 will recoil upwardly therefrom and contact inverted ledge 64, which restricts upward motion of partition 66, as illustrated in FIG. 4C. Finally, as illustrated in FIG. 4D, partition 66 comes to rest against a top portion of the conveyor 4 between upstanding cleats 6. As seen in FIGS. 4A–4D, a lower portion of guiding surface 62 extends to directly below inverted ledge 64, which insures that an upper edge of partition 66 will engage inverted ledge 64 to arrest upward recoiling motion of partition 66.

Figure 3:
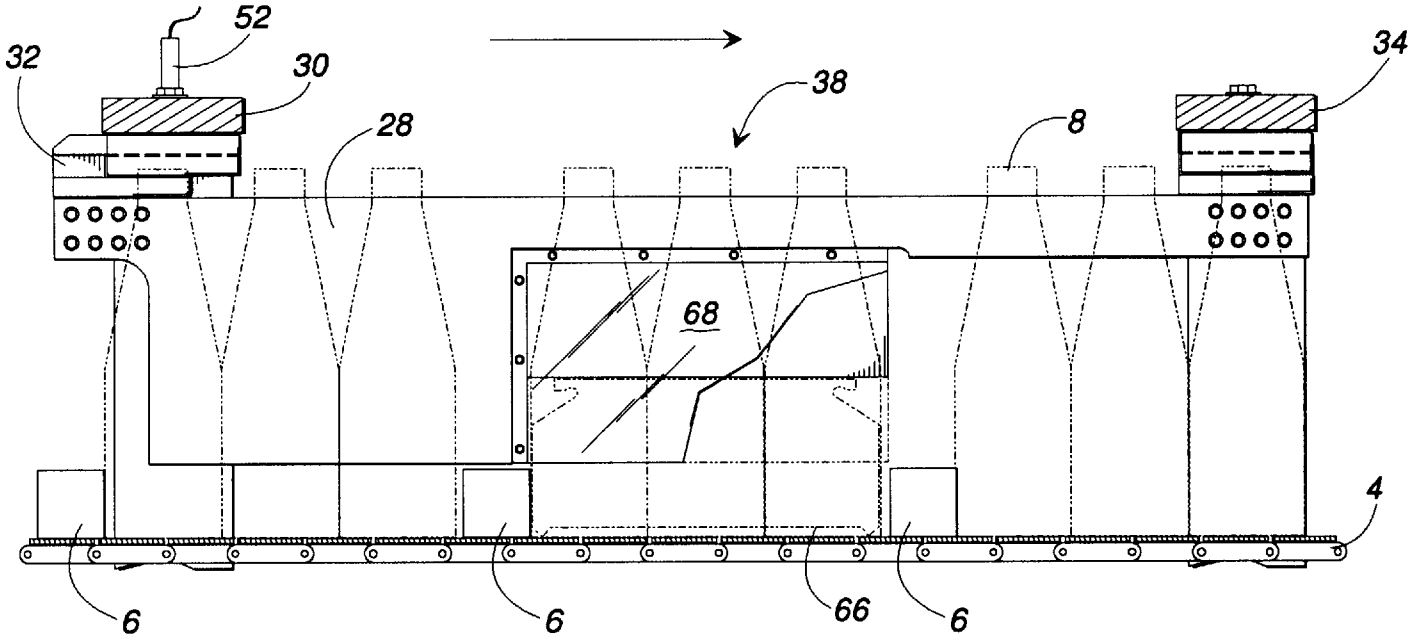
FIG. 3 is a front view of the partition control assembly, taken along line 3—3 of FIG. 2.

FIG. 3 illustrates the position of partition 66 with respect to cleats 6 and the articles 8 in greater detail. The splitter member 28 extends between upstream and downstream transverse members 34, and has a bottom edge which is located slightly above upstanding cleats 6 on flight conveyor 4, which allows the cleats 6 to pass under the partition control assembly 38. Thus, when partition 66 enters the control space of the partition control assembly 38, cleat 6 can move the preconfigured group of articles and the partition 66 downstream because a downstream portion of the partition control assembly 38 is open.

The partition sensor 40 illustrated in FIGS. 1, 2, and 4A–4D allows the packaging machine control system to monitor for the presence of partition within the partition control assembly at particular moments of importance. For example, if sensor 40 detects a partition within the partition control assembly 38 immediately prior to the ejection of another partition, such a detection may indicate a partition jam within the partition control assembly 38, since a partition from a previous ejection cycle has not been carried downstream by an upstanding cleat 6 on flight conveyor 4. Thus, a control system may read a signal from sensor 40 immediately prior to the ejection of a partition into the partition control assembly 38. Under such control scheme, if the control system senses the presence of a partition through sensor 40, the control system may shut down the flight conveyor and/or the partition ejectors.

Alternatively, sensor 40 may sample the control space at predetermined time periods to determine if a partition 66 is present in the control space 76. For example, the control system may sample the sensor signal when the control space 76 is supposed to be empty. If the control system reads a signal from the sensor 40 which indicates the presence of a partition in control space 76 at that time, then control system may deactivate the flight conveyor 4 and/or the partition ejectors to allow qualified personnel to determine if a partition is jammed within the control space. Furthermore, the control system may utilize sensor 40 to detect if a partition is in control space 76 at the correct time, (for instance, immediately after ejection), and shut down the conveyor and/or partition ejector if a partition is not present during the appropriate time period.

Sensor 40 may be an optical device that sends out a light beam and detects a reflection when a partition is disposed in the partition control assembly 38. However, sensor 40 may comprise any sensor which allows the remote detection of a partition within control space 76.

As illustrated schematically in FIG. 2, the partition control assembly may also include a hinge 54 which rotatably mounts the guide member 58 to the splitter member 28 for allowing the guide member to be rotated away from control member 56 for the purpose of removing a jammed partition from control space 76. Additionally, transparent viewing member 68 allows a technician to view the control space 76 for a partition jam. It is also important to note that the partition control assembly 38 is mounted to the lower chassis 12, which is independent of the mounting system of the ejectors. That arrangement allows qualified personnel to move the ejectors, which are slidingly coupled to the upper chassis 14, laterally away from the conveyor, thereby exposing the control assembly 38 in order to facilitate the clearing of a partition jam out of the partition control assembly 38.

It would be obvious to those skilled in the art that many variations may be made in the above embodiments here chosen for the purpose for illustrating the present invention, and full may result may be had to the doctrine of equivalence without departing from the scope of the present invention is defined by the dependent claims.

What is claimed is:

1. For use in combination with a continuous feed mechanism for packaging articles, a partition control assembly adapted to control the downward movement of a wingless partition into a plurality of preconfigured articles on a flight conveyor, said partition control assembly comprising:

a first member disposed below a partition ejector, said first member including a contoured guiding surface for guiding the partition into a lateral, downward direction with respect to the partition ejector;

a second member including a control surface disposed opposite said contoured guiding surface, wherein said control surface limits upward movement of the partition; and an inverted ledge disposed on said control surface for engaging a top edge of the partition to prevent the partition from recoiling upwardly from within the plurality of preconfigured articles after an initial contact between the partition and the flight conveyor.

2. The partition control assembly of claim 1 further comprising:

a control space between said control and contoured guiding surfaces; and a hinge for mounting one of said first and second members to said assembly, wherein said hinge allows one of said first and second members to be rotated away from said assembly to provide for access to said control space.

3. The partition control assembly of claim 1 wherein said contoured guiding surface tapers toward said control surface in a downward direction.

4. The partition control assembly of claim 3 wherein a bottom portion of said contoured guiding surface extends directly below said inverted ledge.

5. The partition control assembly of claim 1 wherein said partition control assembly is mounted within a group splitter above said flight conveyor.

6. The partition control assembly of claim 1 wherein said partition control assembly is located downstream of a leading edge of a group splitter.

7. The partition control assembly of claim 1 wherein a portion of said second member, below said inverted ledge, is constructed from a transparent material for allowing monitoring of said partition control assembly for partition jams.

8. The partition control assembly of claim 1 further including:

sensing means responsive to a partition jam in said partition control assembly for deactivating the flight conveyor.

9. The partition control assembly of claim 1 further including:

sensing means responsive to a partition jam in said partition control assembly for deactivating the partition ejector.

10. The partition control assembly of claim 1 further comprising:

sensing means for detecting a partition jam in said partition control assembly, wherein said sensing means senses for the presence of a partition in said partition control assembly immediately prior to ejection of a partition into the group of articles.

11. The partition control assembly of claim 1 further comprising:

sensing means for detecting a partition jam in partition control assembly, wherein said sensing means senses for the presence of a partition in said partition control assembly in synchronization with predetermined flight conveyor positions.

12. The partition control assembly of claim 1 further comprising:

means for allowing movement of said partition control assembly in a direction of flight conveyor movement upon encountering excessive resistance from articles on the flight conveyor; and sensing means responsive to downstream movement of said partition control assembly for deactivating the flight conveyor.

13. A packaging machine for processing articles along a longitudinal path and for directing articles into a container comprising:

article infeed means for arranging the articles into preconfigured groups;

a flight conveyor for moving preconfigured groups of articles along a longitudinal path;

a partition ejector disposed above said flight conveyor for ejecting a partition in a downward direction into a preconfigured group of articles below said partition ejector on said flight conveyor; and a partition control assembly disposed between said partition ejection mechanism and said flight conveyor, wherein said partition control assembly prevents the partition from recoiling out of the preconfigured group of articles after an initial contact with said flight conveyor, said partition control assembly comprising a first member disposed below said partition ejector, said first member including a contoured guiding surface for guiding the partition into a lateral, downward direction with respect to said partition ejector; and a second member including a control surface disposed opposite said contoured guiding surface and including an inverted ledge for engaging a top edge of the partition and thereby preventing the partition from recoiling upwardly from the flight conveyor and out of the plurality of preconfigured articles.

14. The packaging machine of claim 13 further comprising:

a control space between said contoured guiding surface and said control surface;

a hinge for mounting one of said first and second members to said assembly, wherein said hinge allows one of said first and second members to be rotated away from assembly for allowing access to said control space.

15. The packaging machine of claim 13 wherein said contoured guiding surface tapers toward said control surface in a downward direction.

16. The packaging machine of claim 13 wherein a bottom portion of said contoured guiding surface extends directly below said inverted ledge.

17. The packaging machine of claim 13 wherein said control assembly is mounted within a group splitter above said flight conveyor.

18. The packaging machine of claim 17 wherein said partition control assembly is located downstream of a leading edge of said group splitter.

19. The packaging machine of claim 13 wherein a portion of said second member, below said inverted ledge, is constructed from a transparent material for allowing monitoring of said partition control assembly for partition jams.

20. The packaging machine of claim 13 further comprising:

sensing means responsive to a partition jam in said partition control assembly for deactivating the flight conveyor.

21. The packaging machine of claim 13 further comprising:

sensing means responsive to a partition jam in said partition control assembly for deactivating said partition ejector.

22. The packaging machine of claim 13 further comprising:

sensing means responsive to a partition jam in said partition control assembly, wherein said sensing means senses for the presence of a partition in said partition control assembly immediately prior to the ejection of a partition into a group of articles.

23. The packaging machine of claim 13 further comprising:

sensing means responsive to a partition jam in said partition control assembly, wherein said sensing means senses for the presence of a partition in said partition control assembly in synchronization with predetermined flight conveyor positions.

24. The packaging machine of claim 13 further comprising:

means for allowing movement of said partition control assembly in a direction of flight conveyor movement when said partition control assembly encounters excessive resistance from articles on the flight conveyor; and sensing means responsive to downstream movement of said partition control assembly for deactivating the flight conveyor.

25. A method for controlling the ejection of a partition into a group of preconfigured articles on a flight conveyor, comprising the steps of:

aligning a group of preconfigured articles on the flight conveyor with a partition ejector positioned above the flight conveyor;

ejecting a partition downward into the group of preconfigured articles;

restraining the partition from upward movement after said partition travels a predetermined downward distance; and deflecting the partition laterally with respect to a longitudinal axis of flight conveyor movement, prior to said step of restraining the partition from upward movement.

26. The method of claim 25 comprising the further step of:

sensing for the presence of a partition below a partition ejector.

27. The method of claim 26 comprising the further step of:

deactivating the flight conveyor in response to detecting the presence of a partition.

28. The method of claim 26 comprising the further step of:

deactivating the partition ejector in response to detecting the presence of a partition.

29. The method of claim 26 comprising the further step of:

deactivating the flight conveyor in response to not detecting the presence of a partition.

30. The method of claim 26 comprising the further step of:

deactivating the partition ejector in response to not detecting the presence of a partition.

31. The method of claim 25 comprising the further step of:

sensing for the presence of a partition below the partition ejector in synchronization with predetermined flight conveyor positions.

32. The method of claim 31 comprising the further step of:

deactivating the flight conveyor in response to detecting the presence of a partition.

33. The method of claim 31 comprising the further step of:

deactivating the partition ejector in response to detecting the presence of a partition.

34. The method of claim 31 comprising the further step of:

deactivating the flight conveyor in response to not detecting the presence of a partition.

35. The method of claim 31 comprising the further step of:

deactivating the partition ejector in response to not detecting the presence of a partition.

36. The method of claim 25 comprising the further step of:

providing a partition control assembly for performing said partition restraining step;

splitting the preconfigured group of articles into two portions with said partition control assembly; and allowing said partition control assembly to move in a direction of conveyor movement when said partition control assembly encounters excessive resistance from articles on the flight conveyor.

37. The method of claim 37 comprising the further step of:

sensing for movement the partition control assembly in a direction of flight conveyor movement.

38. The method of claim 37 comprising the further step of:

deactivating the flight conveyor in response to sensing movement of the partition control assembly in a direction of flight conveyor movement.

* * * * *